US006914201B2

(12) United States Patent
Van Vooren et al.

(10) Patent No.: US 6,914,201 B2
(45) Date of Patent: Jul. 5, 2005

(54) MULTIPLE DETENT SWITCH

(75) Inventors: Gregory P. Van Vooren, Carthage, IL (US); William F. Swisher, Carthage, IL (US)

(73) Assignee: Methode Electronics, Inc., Chicago, IL (US)

( * ) Notice: Subject to any disclaimer, the term of this patent is extended or adjusted under 35 U.S.C. 154(b) by 33 days.

(21) Appl. No.: 10/721,187

(22) Filed: Nov. 26, 2003

(65) Prior Publication Data

US 2005/0109591 A1 May 26, 2005

(Under 37 CFR 1.47)

(51) Int. Cl.[7] ..... H01H 9/00
(52) U.S. Cl. ..... 200/1 B; 200/339
(58) Field of Search ..... 200/1 B, 4, 6 R, 200/17 R, 18, 339, 553

(56) References Cited

U.S. PATENT DOCUMENTS 5,598,918 A * 2/1997 Malecke et al. ..... 200/558
5,693,920 A * 12/1997 Maeda ..... 200/1 B
5,719,361 A * 2/1998 Lee ..... 200/1 B
5,753,874 A * 5/1998 Kossakowski ..... 200/1 B
5,834,716 A * 11/1998 Lee ..... 200/5 R
6,437,259 B1 * 8/2002 Geppert et al. ..... 200/5 R
6,693,246 B1 * 2/2004 Rudolph et al. ..... 200/1 B

* cited by examiner

*Primary Examiner*—Michael A. Friedhofer
(74) *Attorney, Agent, or Firm*—Blank Rome LLP

(57) ABSTRACT

A multifunctional switch for any automobile application having a need for a multiple detent switch. The switch includes a button that is moveably connected to a base. The switch includes a first lever connected to the button at a point of the first lever that is closer to a first end of the first lever than a second end of the first lever. The switch also includes a first tactile bridge fixed to the base. The first tactile bridge is adapted to be contacted by the first end of the first lever and thereby close a first switch. The switch further includes a second tactile bridge fixed to the base. The second tactile bridge is adapted to be contacted by the second end of the first lever and thereby close a second switch.

23 Claims, 5 Drawing Sheets

MULTIPLE DETENT SWITCH

BACKGROUND OF THE INVENTION

The present invention relates generally to switches. More particularly, the present invention relates to automobile switches that perform multiple functions.

One type of switch commonly found in an automobile is a pushbutton. Pushbuttons enable the automobile driver to press a spring loaded button to make an electrical contact or connection. Pushbuttons can be momentary or latching. With momentary pushbuttons, when the automobile driver stops pressing the button, the spring in the button opens the switch and current flow discontinues as does the associated automobile function. Momentary pushbuttons may control intermittent functions such as front or rear windshield washes, temporary windshield wipes, radio frequency scans, seeks or band selections as well as momentary illuminations of interior or exterior lights.

With latching pushbuttons, when the automobile driver stops pressing the button, the switch remains closed and current flow continues. The driver presses the latching pushbutton again or presses a separate release button to unlatch the button, stop current flow and thereby halt the associated automobile function. Latching pushbuttons initiate and maintain many automobile functions such as front or rear windshield wipers, windshield wiper speed settings, radio on/off, interior or exterior lighting on/off and turn signal on/off.

Automobiles also commonly provide rocker switches or toggle switches (hereafter both referred to as "rocker switch"), which are in many cases two pushbuttons in one housing and are therefore useful for higher/lower momentary features or on/off latching features. If pushed in one direction, the rocker switch closes an electrical path and allows current to flow to initiate a function. If pushed in another direction, the rocker switch closes a second electrical path and allows current to initiate another function. Rocker switches can be momentary or latching. Rocker switches can also be two position buttons or three position buttons. Accordingly, rocker switches have a variety of uses in automobiles.

In one type of use, the two position rocker switch latches a function in an active state if pushed in one direction and maintains the same function in an inactive state if pushed in the other direction. For example, the rocker switch can latch the outside headlights in an illuminated state if pushed in one direction and maintain them in an off state if pushed in another direction.

In another type of use, the two position rocker switch latches a first activated function if pushed in one direction and latches a second activated function if pushed in the other direction. For example, the rocker switch can latch illuminated headlights if pushed in one direction and latch illuminated fog lights if pushed in the other direction. If the headlights are on, the fog lights are off and vice versa.

In a further type of use, the two position rocker switch momentarily activates a first function if pushed in one direction and momentarily activates a second function if pushed in the other direction. In still a further type of use, the two position rocker switch momentarily activates a first function if pushed in one direction and latches a second function if pushed in the other direction.

The three position rocker switch also has these types of uses and adds a third or off position, so that: (i) two functions can be momentarily activated or set to an off position; (ii) two functions can be latched or set to an off position; or (iii) one function can be momentarily activated, one latched or the functions can be set to an off state. Although known rocker switches combine the functionality of a plurality of pushbuttons, the increasing functional demands as well as automobile interior space economy require that switches provide even more functionality, which means more electrical contacts.

One solution has been the "dual detent" rocker switch. Dual detent rocker switches have been adapted to close two contacts and thereby perform two functions when pushed for different distances in a single direction. These types of switches are commonly used with power windows, sunroofs, etc., such that depression of the button in a first direction for a first distance causes momentary window movement while depression of the button in the first direction for a second distance causes a latched or maintains window movement. Dual detent buttons essentially double the functionality of normal rocker switches.

The dual detent rocker switches to this point, however, have required for activation in one direction, separate cams, multiple detent plungers, a detent ramp and/or springs, etc. The extra number of components, especially for original equipment manufacturers: (i) increases material costs; (ii) complicates and adds cost to the necessary tooling; and (iii) complicates and adds cost to the assembly process. The extra components, materials and assembly are necessary to provide the switching functions as well as tactile feedback to the driver. Tactile feedback enables the driver to feel when electrical contact is made, i.e., when the electrical function is initiated. Tactile feedback is especially important with dual detent switches because the driver must sense the difference between varying degrees of movement in the same direction.

A need therefore exists to make a less complicated dual or multiple detent button, which provides tactile feedback that is reliable and repeatable, so that the driver feels the same sensation each time the driver uses the switch.

SUMMARY OF THE INVENTION

The present invention provides an improved multifunctional switch. More specifically, the present invention provides an improved multifunctional switch for any automobile application having a need for a multiple detent switch.

To this end, in an embodiment of the present invention, a switch is provided. The switch includes a button that is moveably connected to a base. The switch includes a first lever connected to the button at a point of the first lever that is closer to a first end of the first lever than a second end of the first lever. The switch also includes a first tactile bridge fixed to the base. The first tactile bridge is adapted to be contacted by the first end of the first lever and thereby close a first switch. The switch further includes a second tactile bridge fixed to the base. The second tactile bridge is adapted to be contacted by the second end of the first lever and thereby close a second switch.

In an embodiment, the button is rotatably or pivotally connected to the base.

In an embodiment, the first lever is rotatably or pivotally connected to the button.

In an embodiment, the button is connected to a pivot. The pivot is fixed to the base, and the first end of the first lever is positioned to face towards the pivot.

In an alternative embodiment, the button is connected to a pivot. The pivot is fixed to the base, and the second end of the first lever is positioned to face towards the pivot.

In an embodiment, the connection point of the first lever is located at a distance that is at least twice as close to the first end of the first lever than the second end of the first lever.

In an embodiment, the first and second tactile bridges are metal pieces formed so as to deform in a predefined manner when a force is applied to the first and second tactile bridges.

In an embodiment, the first and second tactile bridges are metal pieces formed so as to return to a predefined shape upon the release of a force applied to the first and second tactile bridges.

In an embodiment, the switch includes a second lever, which is attached to the button at a point of the second lever that is closer to a first end of the second lever than a second end of the second lever.

In an embodiment, the switch includes a third tactile bridge fixed to the base. The third tactile bridge is adapted to be contacted by the first end of the second lever and thereby close a third switch.

In an embodiment, the switch includes a fourth tactile bridge fixed to the base. The fourth tactile bridge is adapted to be contacted by the second end of the second lever and thereby close a fourth switch.

In an embodiment, the second lever is rotatably or pivotally attached to the button.

In an embodiment of the present invention, a multiple detent switch is provided. The multiple detent switch includes a button connected to a button pivot that is attached to a base. The multiple detent switch includes a first lever connected to a first pivot, which is fixed to the button. The first lever includes a first and a second end, and the first pivot is closer to one of the first or the second ends of the first lever. The first lever is adapted to close a plurality of switches that are fixed to the base. The multiple detent switch also includes a second lever connected to a second pivot fixed to the button. The second lever includes a first and a second end, and the second pivot is closer to one of the first or the second ends of the second lever. The second lever is adapted to close a switch that is fixed to the base.

In an embodiment, the switches electrically communicate with connectors that are attached to leads. The leads are adapted to electrically communicate with an external electrical device.

In an embodiment, the second lever is adapted to close a plurality of switches that are fixed to the base.

In an embodiment, the ends of the levers that are closer to the pivot are positioned to face towards the button pivot.

In an alternative embodiment, the ends of the levers that are closer to the pivot are positioned to face away from the button pivot.

In an embodiment of the present invention, a method for enabling the activation of functions in an automobile is provided. The method includes the step of providing a detent switch that has a button, where the switch is to be installed in the automobile. The method also includes the step of enabling a first switch to be closed by a first lever in response to moving the button in a first direction a first distance. The method further includes the step of enabling a second switch to be closed by the first lever in response to moving the button in the first direction a second distance.

In an embodiment, the method further includes the step of enabling a third switch to be closed by a second lever in response to moving the button in a second direction a first distance.

In an embodiment, the method further includes the step of enabling a fourth switch to be closed by a second lever in response to moving the button in a second direction a second distance.

An advantage of the present invention is to provide a simplified and improved multifunctional automobile switch.

Another advantage of the present invention is to provide a multiple detent switch.

Moreover, an advantage of the present invention is to provide a multiple detent switch that is repeatable and reliable.

A further advantage of the present invention is to provide a simplified multiple detent switch.

Furthermore, an advantage of the present invention is to provide a detent switch that affords the driver or user adequate tactile feedback for each contact closure.

Additional features and advantages of the present invention will be described in and apparent from the detailed description of the presently preferred embodiments.

DETAILED DESCRIPTION OF THE PRESENTLY PREFERRED EMBODIMENTS

Figure 1:
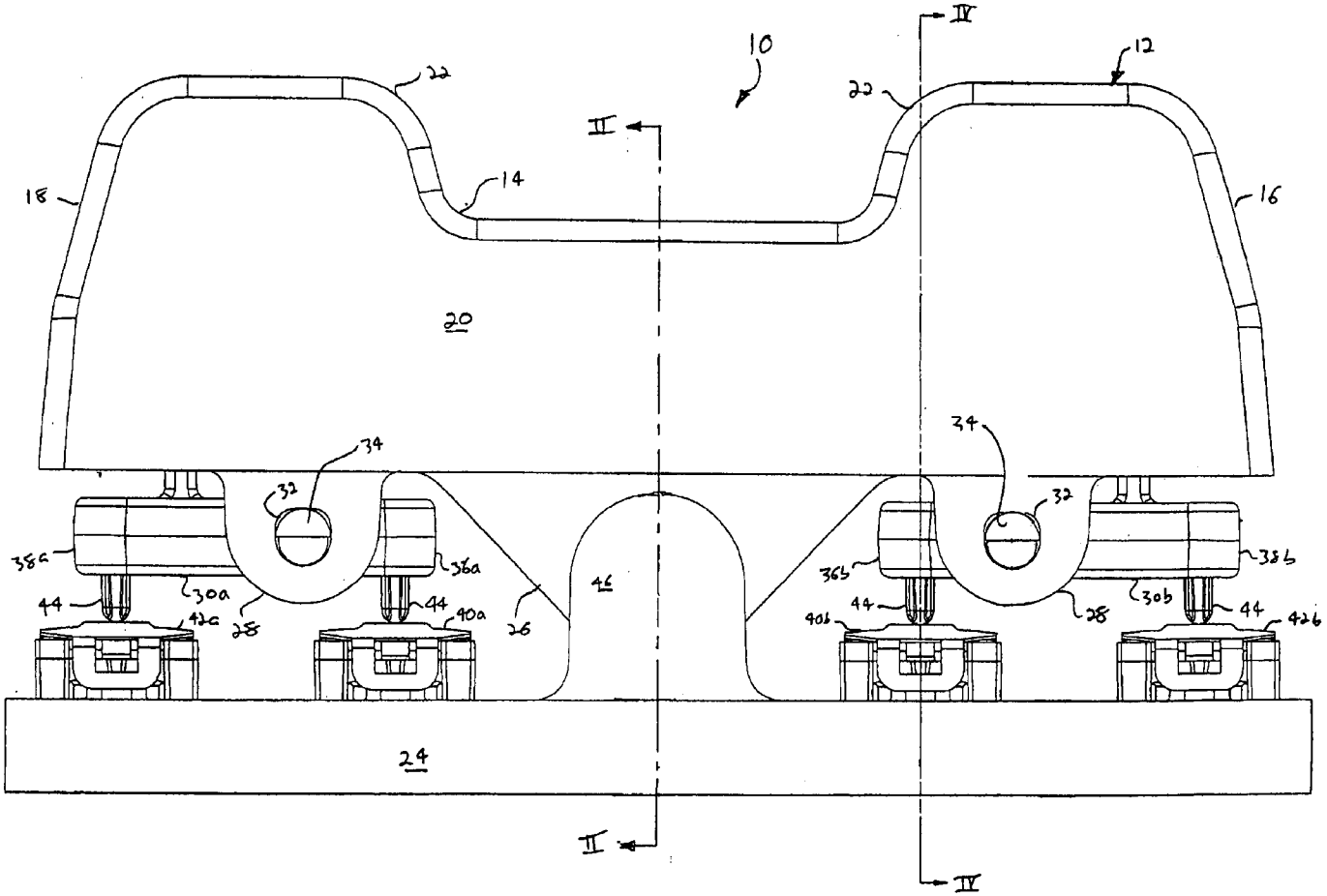
FIG. 1 is a side elevation view of an embodiment of the multiple detent switch of the present invention.

Referring to the drawings, FIG. 1 illustrates an embodiment of the multiple detent switch 10 of the present invention. The switch 10 includes a button 12 having a top wall 14, a front wall 16, a rear wall 18 and a plurality of side walls 20. The button 12 is open at the bottom and therefore forms a shell. The shell-like top 14 preferably has one or more projections 22 that aid the driver or user of the switch in pushing, rotating or otherwise moving the button 12 to make one of a plurality of switch closures and thereby activate an automobile function.

The projections 22 as well as other ergonomic and aesthetic formations are preferably formed via known injection molding or blow molding techniques, wherein the button 12 is plastic. The button 12 is alternatively made of any strong, lightweight and easily formed material. The button 12 may be adapted to have different colors and/or textures or grains in accordance with the use and placement of the switch 10. The button 12 including the projections 22 may further be adapted to include indicia that informs the driver or user as to the switch's operation and/or function.

In one preferred embodiment, the button 12 is a rocker button that pivotally or rotatably connects to a base 24. The base 24 is also preferably molded plastic. The connection between the button 12 and the base 24 is preferably along a midline of the button 14 as well as a midline of the base 24. Although the button 12 is illustrated as a rocker button, the switch 10 may be adapted to include any type of bi-directional switch. For example, the button 12 may be adapted to be a toggle button or a thumbwheel, wherein each can be moved or rotated in at least two directions.

In the preferred embodiment, the button 12 forms a pair of downwardly projecting flanges 26 on either side 20 of the button. The flanges 26 are adapted to pivotally connect the button 12 to the base 24 as further illustrated in FIG. 2. The button 12 also forms a pair of downwardly projecting tabs 28 on both sides 20 of the button. The tabs 28 are adapted to pivotally connect a pair of levers 30*a* and 30*b* to the button 12. The tabs 28 each define an aperture 32, which is sized to receive a lever pivot 34. The lever pivots 34 are preferably integrally formed with the levers 30*a* and 30*b* and thus rotate with resect to the tabs 28. The lever pivots 34 are alternatively integrally formed with the tabs 28 so that the levers 30*a* and 30*b* rotate with respect to the pivots 34.

The levers 30*a* and 30*b* each have an inner end 36*a* and 36*b*, respectively. The levers 30*a* and 30*b* each have an outer end 38*a* and 38*b*, respectively. Each of the inner ends 36*a* and 36*b* are adapted to contact inner tactile bridges 40*a* and 40*b*. Each of the outer ends 38*a* and 38*b* are adapted to contact outer tactile bridges 42*a* and 42*b*. In one preferred embodiment, the levers each have downwardly projecting knobs 44, which contact the tactile bridges 40*a*, 40*b*, 40*c* and 40*d*.

The base 24 includes a plurality of mounts 46, which are preferably integrally formed with the base. In one embodiment, each mount 46 includes a separate pivot (illustrated in FIG. 2) for pivotally or rotatably connecting the button 12. The button 12 is thus pivotally held in place by the mounts 46 and supported on either side by a plurality of inner tactile bridges 40*a* and 40*b* and a plurality of outer tactile bridges 42*a* and 42*b*. It should be appreciated that the button 12 is constrained from moving unless a driver presses a projection 22 on either the front wall 16 or rear wall 18 end of the button and deforms one or both of the tactile bridges on that end.

Figure 2:
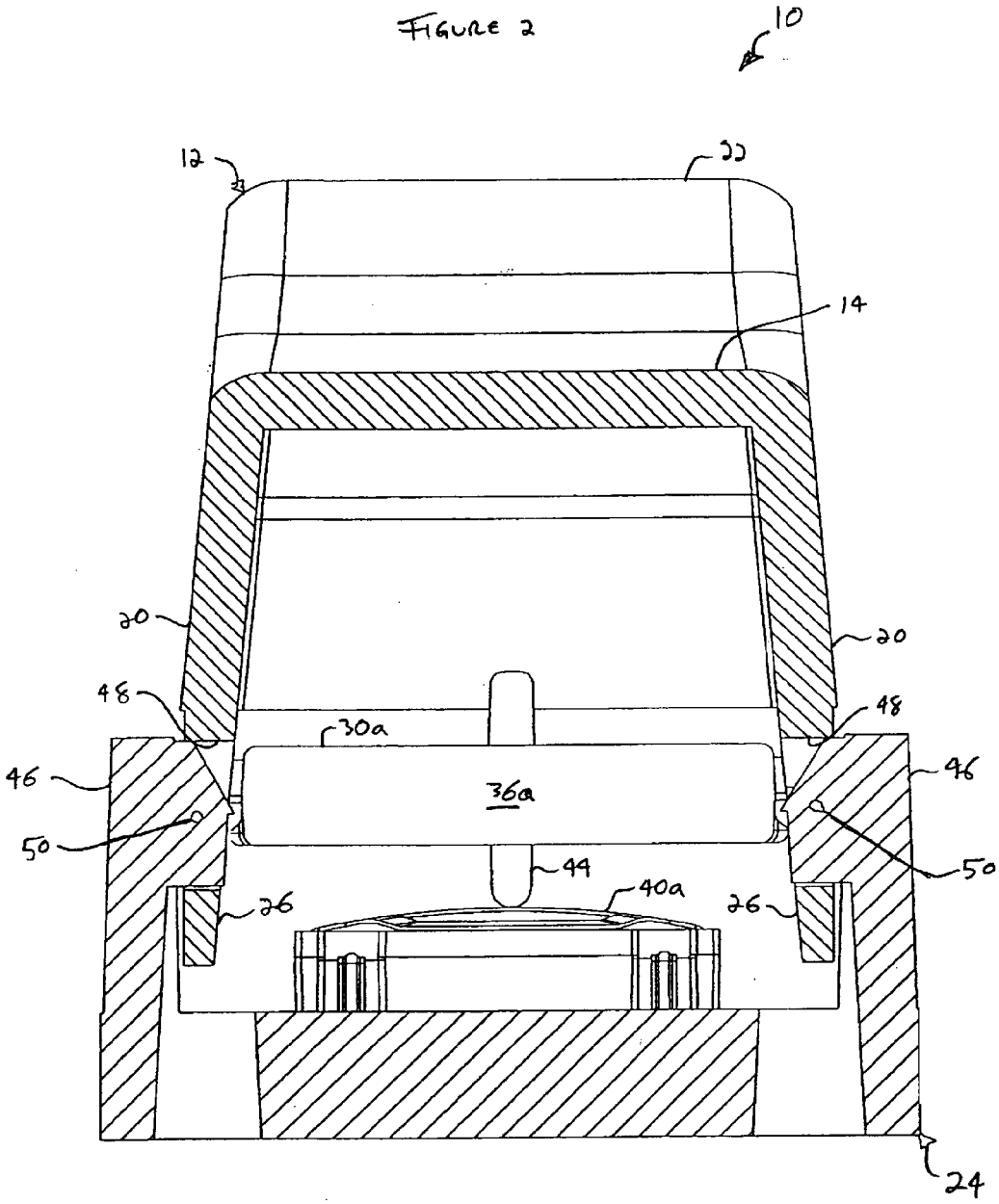
FIG. 2 is a cross section view taken through the line II—II of FIG. 1, which illustrates one embodiment for attaching the button to the base.

Referring now to FIG. 2, a view from the front wall 16 end of the switch 10 of a cross section taken through the middle of the switch illustrates one embodiment for pivotally attaching the button 12 to the base 24. This view shows the projection 22 extending upward from the top wall 14. The side walls 20 form the flanges 26 as illustrated above. The flanges 26 each define a button aperture 48. The button apertures are adapted to receive button pivots 50, which are integrally formed with the mounts 46 of the base 24. The pivots 50 individually snap into or otherwise fit into the apertures 48 of the base 24, so that the button 12 is constrained to pivot about the button pivots 50.

FIG. 2 also illustrates the inner end 36*a* of the lever 30*a*, wherein the lever 30*a* includes the knob 44. The knob 44 sits on or otherwise contacts the inner tactile bridge 40*a*. When the driver or user presses the projection 22, the button 12 pivots about the pivots 50, such that the knob 44 presses against the tactile bridge 40*a*. Each of the tactile bridges including the bridge 40*a* is in one preferred embodiment a deformable piece of conductive material or metal. The tactile bridge 40*a* has a slightly rounded shape that is designed to give or flatten out after the application of an amount of force to the outside of the rounded shape. The giving way or flattening out of the circular shape creates a slight snapping or popping sensation, which the driver senses. The giving way or flattening out of the circular shape also creates an electrical contact, i.e., closes a switch, which initiates an automobile function such as running a motor adapted to open or close a window. When the driver releases the projection, the spring-like tactile bridge 40*a* returns to its formed, circular shape and returns the button 12 to its original position through the bridge's contact with the knob 44. The electrical contact caused by the bridge 40*a* is thereby broken.

Figure 3:
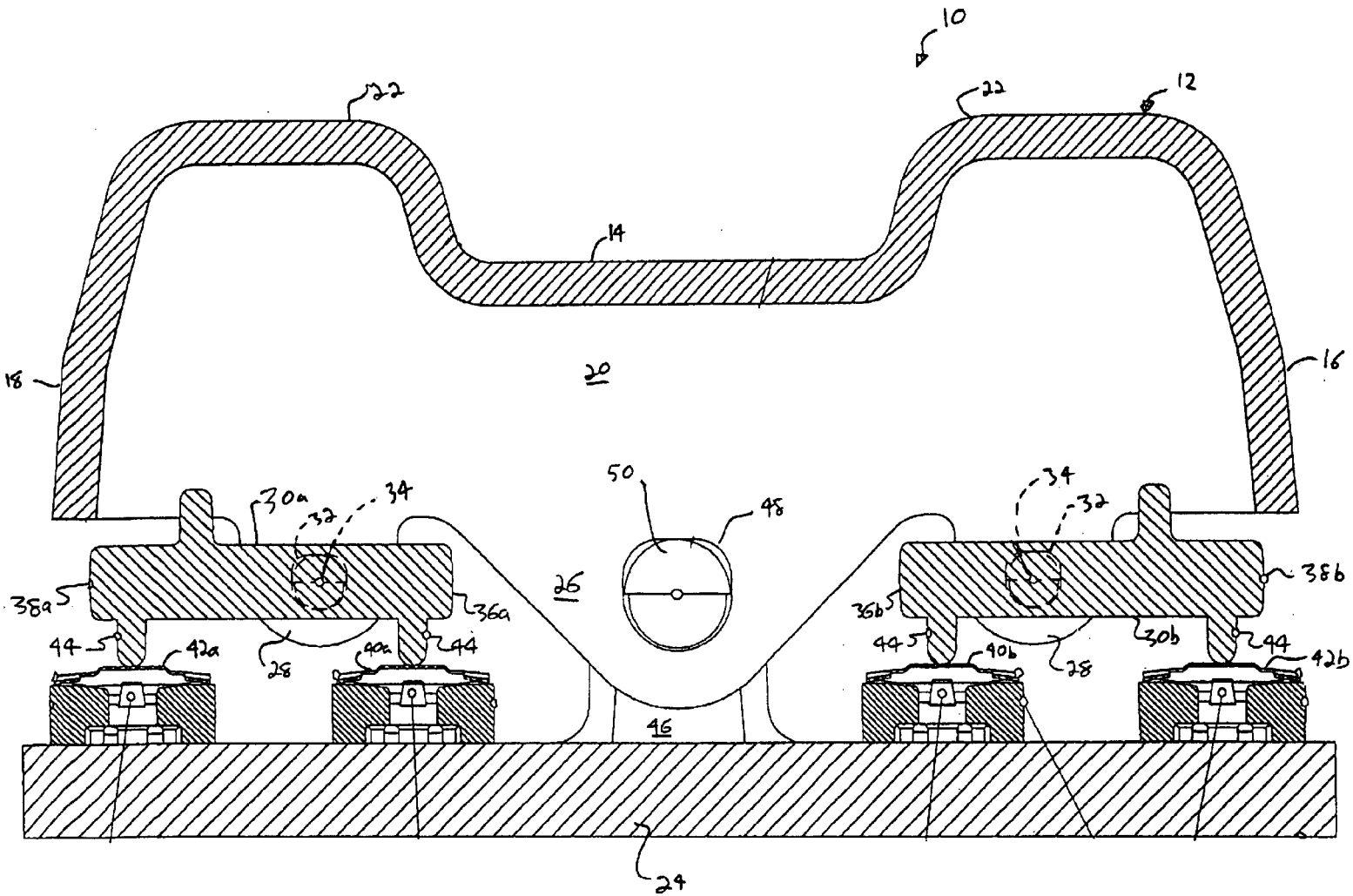
FIG. 3 is a section view of the side elevation view of FIG. 1.

Referring now to FIG. 3, a lengthwise section of the switch 10 of FIG. 1 is illustrated. The section of the button 12 includes the top wall 14, the front wall 16, rear wall 18 and one side wall 20. The side wall 20 includes the flange 26, which defines the aperture 48 for receiving the button pivot 50, which is preferably integral to the side wall. FIG. 3 illustrates the inner side of the wall 20 and therefore shows the button pivot 50 projecting inwardly from the mount 46, which is attached to the base 24 in back of or outside of the side wall 20.

FIG. 3 also illustrates the flanges 28 projecting downwardly from the wall 20 in back of or outside of the levers 30*a* and 30*b*, which have been sectioned. The levers 30*a* and 30*b* respectively include inner walls 36*a* and 36*b* that face inwardly towards the pivot 50/aperture 48 interface. The levers 30*a* and 30*b* also respectively include outer walls 38*a* and 38*b* that face away from the pivot 50/aperture 48 interface.

The flanges 28 of wall 20 also define the tab apertures 32 (shown in phantom), which receive the lever pivots 34 (shown in phantom). It should be appreciated that the lever pivot 34/tab aperture 32 interfaces, for both levers 30*a* and 30*b*, are positioned closer to the knobs 44 adjacent to the inner ends 36*a* and 36*b* than the knobs 44 adjacent to the outer end 38*a* and 38*b*. In one preferred embodiment, the pivot 34/aperture 28 interfaces are positioned twice as close to the inner knobs 44 than to the outer knobs 44.

When the driver presses one of the projections 22, the force of the driver is transmitted through the button 12, through to the levers 30*a* and to the inner and outer tactile bridges 40*a*, 40*b* and 42*a*, 42*b*, respectively. Assuming each tactile bridge is the same, e.g., same material, size and shape, each bridge applies the same resistive force to the pressure exerted through the knobs 44. Because a lever arm to the outer bridges, i.e., the perpendicular distance from the pivot 34/aperture 32 interfaces to the outer knobs 44, is longer than the lever arm to the inner bridges, i.e., the perpendicular distance from the pivot 34/aperture 32 interfaces to the inner knobs 44, the torque applied by the outer bridges is greater than the torque applied by the inner bridges. Since torque linearly depends on distance, the disparity of the torque applied by the outer bridges versus the inner bridges is in the same proportion as the disparity between the distances of the lever arms.

As a consequence of the torque disparity caused by the off-center or non-enter positioning of the pivot 34/aperture 32 interfaces, the inner tactile bridges 40*a* and 40*b* always deform and close their respective switches before the outer tactile bridges 42*a* and 42*b* deform and close their respective switches, assuming the tactile bridges or other components do not degrade. The tactile nature of the bridges enables the driver to feel the deformation of the inner bridges before the deformation of the outer bridges. That is, the driver can sense when pressing the button 12 a first distance in a first direction causes an automobile function to occur and when pressing the button 12 a second distance in the first direction causes a second function to occur. In the illustrated embodiment, the same tactile sensations occur when the driver presses the button in the other direction. In all, the switch 10 enables the driver to feel four different switch closures.

Further, when the driver releases the button 12, the torque disparity will always cause the outer bridges 42*a* and 42*b* to return to their formed shape and open their respective switches before the inner bridges 40*a* and 40*b*. The difference in the lever arm distances as well as the spring force of the tactile bridges in one embodiment are chosen so that the driver can operate the functions associated with the inner tactile bridges 40*a* and 40*b* without necessarily operating the functions associated with the outer tactile bridges 42*a* and 42*b*. Operating the functions associated with the outer tactile bridges, in the illustrated embodiment, however, necessitates that the inner tactile bridges are also closed.

It should be appreciated that the present invention includes obtaining the opposite results by positioning the pivot 34/aperture 32 interfaces closer to the knobs 44 associated with the outer ends 38*a* and 38*b* and the outer tactile bridges 42*a* and 42*b*. That is, the driver could operate the functions associated with the outer tactile bridges 42*a* and 42*b* without necessarily operating the functions associated with the inner tactile bridges 40*a* and 40*b*. Operating the functions associated with the inner tactile bridges, in this alternative embodiment, necessitates that the outer tactile bridges are also closed. It should further be appreciated that the present invention includes the provision of two detents or switches in one direction and: (i) no detents or switches in the other direction (two switches total); (ii) one detent or switch in the other direction (three switches total); or (iii) two detents or switches in the other direction (four switches total).

The switch 10 of the present invention is adaptable for many uses. Pressing in one direction, the driver can open or close a window at a low via the inner bridge or a high speed via the outer bridge. The bridges may be adapted to initiate latching coils, so that maintained or latching connections are made. For instance, in one direction the inner bridge initiates a momentary or intermittent window movement, whereby when the driver releases the button, the window stops moving. In the same direction, the outer bridge initiates a latching circuit that lets the driver release the button while the window slides all the way up or down, wherein a separate limit or position switch senses when the window is totally up or down and opens the latching circuit, cutting current flow to the window motor.

In another example, in one direction the inner bridges initiate a latching circuit that lets the driver release the button while a function, such as a light, windshield wiper or windshield washer, etc., runs continuously. When the driver pushes the button in the same direction and deforms the outer bridge, the electrical connection opens up the latching circuit and the continuous function stops. As herein described, the switch 10 may be adapted to control automobile functions in a momentary or maintained manner including, window movements, mirror movements, windshield wipers, windshield washes, turn signals, radio scans, radios seeks, radio volume and other functions.

Figure 4:
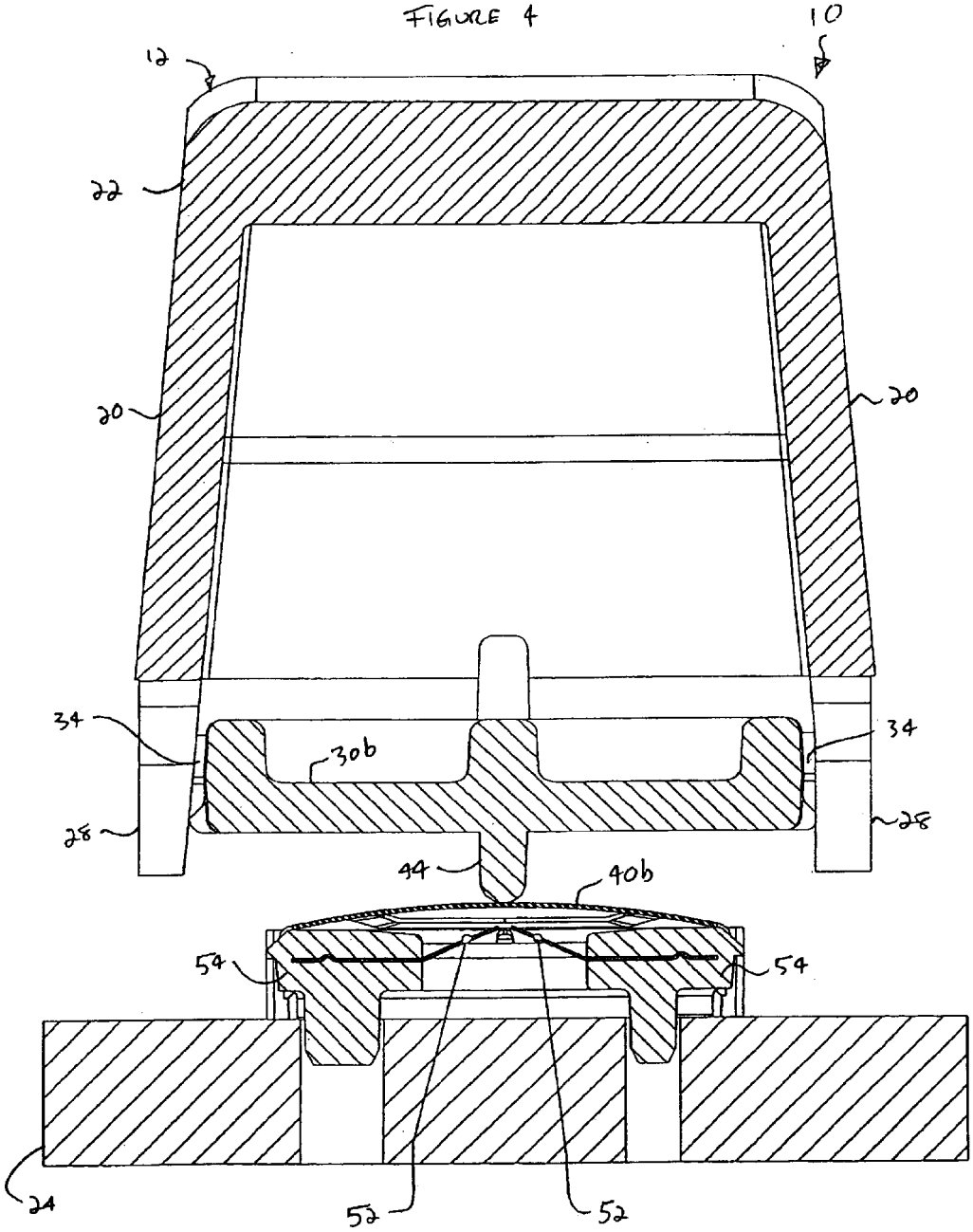
FIG. 4 is a cross section view taken through the line IV—IV of FIG. 1, which illustrates one switch of the present invention.

Referring now to FIG. 4, a view from the rear wall 18 end of the switch 10 of a cross section taken through the knob 44/tactile bridge 40*b* interface illustrates the one embodiment for the electrical connection by the bridges to connectors 52 beneath the bridges. That is, FIG. 4 illustrates one embodiment of the switches of the present invention In this view, the section is taken through the projection 22 nearer to the rear end 16. The side walls 20 form the flanges 28 as illustrated above. The flanges 26 define apertures that pivotally receive lever pivots 34 formed integrally with the lever 30*b*. The lever pivots 34 individually snap into or otherwise fit into the apertures of the flanges 28, so that the lever 30*b* is constrained to pivot about the lever pivots 34.

The knob 44 formed integrally with the lever 30*b* sits atop the inner tactile bridge 40*b*. The button 12, which is substantially supported by the button pivots 50 (FIG. 2) does not compress the bridge 40*b* without pressure by the driver or user, and the bridge does not normally make electrical contact with the connectors 52. The connectors 52 are imbedded in switch pads 54 and are thereby electrically isolated from the conductive metal bridge 40*b* as well as other conductive materials outside the bridge and/or imbedded in the base 24. Although not illustrated, the connectors 52 are in electrical communication with traces, wires or leads imbedded in the base 24 and switch pad 54. The traces, wires or leads run to one or more areas or ends of the base 24, whereby the switch 10 electrically connects to external cables, wires or ribbons, etc., as is well known in the art.

When the driver presses the projection 22 of the button 12, the knob 44 transmits a force to the conductive tactile bridge 40*b*, which deforms the bridge so that it physically connects to and electrically communicates with the connectors 52, closing a switch. Electrical current is then able to flow from a power source (not illustrated) to the switch 10, through a trace, wire or lead of the switch 10, through one of the connectors 52, through the bridge 40*b*, through the other connector 52, through another trace, wire or lead of the switch 10 and out to a load connection of an automobile electrical device. When the driver releases the button 12, the bridge 40*b* pops up, no current flows from connector 52 to connector 52 and electrical communication ceases. It should be appreciated that each of the tactile bridges 40*a*, 40*b*, 42*a* and 42*b* operates in the same manner.

Figure 5:
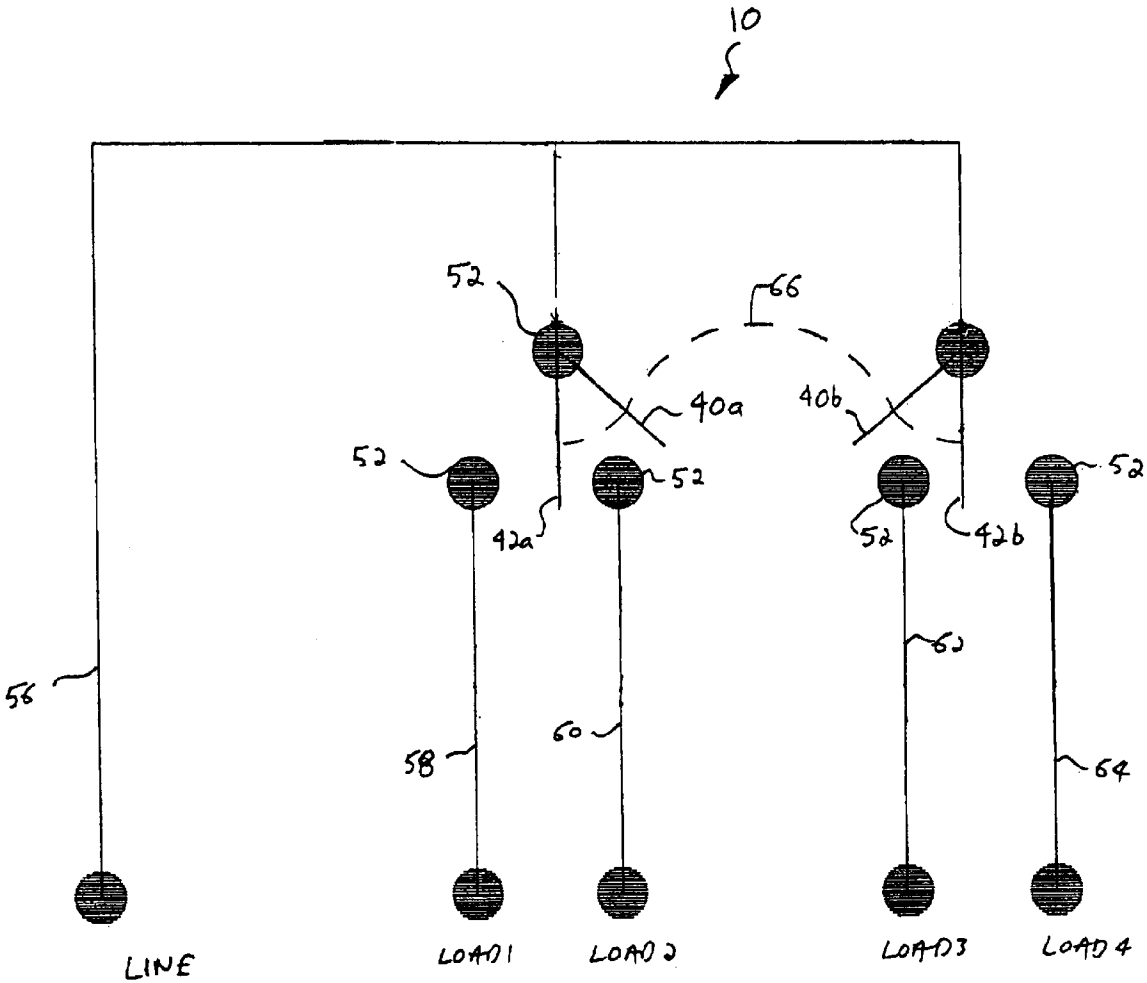
FIG. 5 is a schematic diagram of the electrical layout of the multiple detent switch of the present invention.

Referring now to FIG. 5, a schematic of the electrical layout of the switch 10 is illustrated. The layout is for the preferred multi-switch embodiment that includes four separate switches and is capable of controlling four different automobile functions. The layout includes a line trace, lead or wire 56 which connects to an external power source and to one of the connectors 52 of each of the switches designated by the tactile bridge numbers 40*a*, 40*b*, 42*a* and 42*b*. The layout includes four load traces, leads or wires 58, 60, 62 and 64, which connect to external automobile function devices and to the other of the connectors 52 of each of the switches designated by the tactile bridge numbers 40*a*, 40*b*, 42*a* and 42*b*.

A schematic representation of a bell shaped bridge 66 (shown in phantom) represents each of the four tactile bridges. If the bell is flattened, i.e., when the knob 44 deforms one of the bridges, the switches 40*a*, 40*b*, 42*a* and 42*b* of FIG. 5 are each pushed outward. The inner bridges 40*a* and 40*b* travel a smaller radial distance to electrically communicate with the connectors 52 of the traces 60 and 62, respectively, before the outer bridges 42*a* and 42*b* radially move enough to electrically communicate with the connectors 52 of the traces 58 and 64, respectively. Thus the load devices 2 and 3 of FIG. 5 will begin to function sooner than will the load devices 1 and 4. The driver feels the associated tactile sensations for each of the switch connections as described above.

It should be understood that various changes and modifications to the presently preferred embodiments described herein will be apparent to those skilled in the art. Such changes and modifications may be made without departing from the spirit and scope of the present invention and without diminishing its attendant advantages.

We claim:

1. A switch comprising:

a button moveably connected to a base;

a first lever rotatable connected to the button at a point of the first lever that is closer to a first end of the first lever than a second end of the first lever;

a first tactile bridge fixed to the base, the first tactile bridge adapted to be contacted by the first end of the first lever and thereby close a first switch; and a second tactile bridge fixed to the base, the second tactile bridge adapted to be contacted by the second end of the first lever and thereby close a second switch.

2. The switch of claim 1, wherein the button is rotatably connected to the base.

3. The switch of claim 1, wherein the button is connected to a pivot fixed to the base, and wherein the first end of the first lever is positioned to face towards the pivot.

4. The switch of claim 1, wherein the button is connected to a pivot fixed to the base, and wherein the second end of the first lever is positioned to face towards the pivot.

5. The switch of claim 1, wherein the point of the first lever is located at a distance that is at least twice as close to the first end of the first lever than the second end of the first lever.

6. The switch of claim 1, wherein the first and second tactile bridges are metal pieces formed so as to deform in a predefined manner upon a force applied to the first and second tactile bridges.

7. The switch of claim 1, wherein the first and second tactile bridges are metal pieces formed so as to return to a predefined shape upon a release of a force applied to the first and second tactile bridges.

8. The switch of claim 1, which includes a second lever attached to the button at a point of the second lever that is closer to a first end of the second lever than a second end of the second lever.

9. The switch of claim 8, which includes a third tactile bridge fixed to the base, the third tactile bridge adapted to be contacted by the first end of the second lever and thereby close a third switch.

10. The switch of claim 9, which includes a fourth tactile bridge fixed to the base, the fourth tactile bridge adapted to be contacted by the second end of the second lever and thereby close a fourth switch.

11. The switch of claim 8, wherein the second lever is rotatably attached to the button.

12. A multiple detent switch comprising:

a button connected to a button pivot attached to a base; a first lever connected to a first pivot fixed to the button, the first lever including a first and second end, wherein the first pivot is closer to one of the first or the second ends of the first lever, and the first lever is adapted to close a plurality of switches that are fixed to the base; and a second lever connected to a second pivot fixed to the button, the second lever including a first and a second end, wherein the second pivot is closer to one of the first or the second end of the second lever, and the second lever is adapted to close a switch that is fixed to the base.

13. The multiple detent switch of claim 12, wherein the switches electrically communicate with connectors attached to leads, wherein the leads are adapted to electrically communicate with an external electrical device.

14. The multiple detent switch of claim 12, wherein the second lever is adapted to close a plurality of switches that are fixed to the base.

15. The multiple detent switch of claim 12, wherein the ends of the levers that are closer to the pivot are positioned to face towards the button pivot.

16. The multiple detent switch of claim 12, wherein the ends of the levers that are closer to the pivot are positioned to face away from the button pivot.

17. A method for enabling activation of functions in an automobile comprising the steps of:

providing a detent switch including a button to be installed in the automobile;

enabling a first switch to be closed by a first lever rotatably connected to the button in response to moving the button in a first direction a first distance; and enabling a second switch to be closed by the first lever in response to moving the button in the first direction a second distance.

18. The method of claim 17, which includes the step of enabling a third switch to be closed by a second lever in response to moving the button in a second direction a first distance.

19. The method of claim 18, which includes the step of enabling a fourth switch to be closed by a second lever in response to moving the button in a second direction a second distance.

20. A switch comprising:

a button moveably connected to a base;

a first lever connected to the button at a point of the first lever that is closer to a first end of the first lever than a second end of the first lever, a second lever attached to the button at a point of the second lever that is closer to a first end of the second lever than a second end of the second lever;

a first tactile bridge fixed to the base, the first tactile bridge adapted to be contacted by the first end of the first lever and thereby close a first switch; and a second tactile bridge fixed to the base, the second tactile bridge adapted to be contacted by the second end of the first lever and thereby close a second switch.

21. The switch of claim 20, which includes a third tactile bridge fixed to the base, the third tactile bridge adapted to be contacted by the first end of the second lever and thereby close a third switch.

22. The switch of claim 21, which includes a fourth tactile bridge fixed to the base, the fourth tactile bridge adapted to be contacted by the second end of the second lever and thereby close a fourth switch.

23. The switch of claim 20, wherein the second lever is rotatably attached to the button.

* * * * *